US010927571B2

(12) United States Patent
Bartholdi

(10) Patent No.: US 10,927,571 B2
(45) Date of Patent: Feb. 23, 2021

(54) CLOSING DEVICE WITH A STRONG DETERRENT COMPRESSION SPRING

(71) Applicant: ELDOMAT INNOVATIVE SICHERHEIT GMBH, Berlin (DE)

(72) Inventor: Eberhard Bartholdi, Berlin (DE)

(73) Assignee: ELDOMAT INNOVATIVE SICHERHEIT GMBH, Berlin (DE)

( * ) Notice: Subject to any disclaimer, the term of this patent is extended or adjusted under 35 U.S.C. 154(b) by 656 days.

(21) Appl. No.: 15/078,458

(22) Filed: Mar. 23, 2016

(65) Prior Publication Data

US 2016/0281391 A1 Sep. 29, 2016

(30) Foreign Application Priority Data

Mar. 24, 2015 (DE) ..... 20 2015 002 250.2

(51) Int. Cl.
*E05B 63/20* (2006.01)
*E05B 59/00* (2006.01)
(Continued)

(52) U.S. Cl.
CPC ..... *E05B 63/20* (2013.01); *E05B 15/04* (2013.01); *E05B 59/00* (2013.01); *E05C 1/12* (2013.01); *E05C 9/02* (2013.01); *E05B 2001/0076* (2013.01); *E05B 2015/0448* (2013.01); *E05B 2063/207* (2013.01)

(58) Field of Classification Search
CPC ..... E05C 1/12; E05C 9/02; E05B 15/0086; E05B 15/04; E05B 63/20; E05B 63/205; E05B 59/00; E05B 2001/0076; E05B 2015/0448; E05B 2015/0413; E05B 2063/207; E05B 2015/0496; E05B 63/08; Y10S 292/24; Y10S 292/26; Y10S 292/61; Y10S 292/44; Y10S 292/52; Y10T 292/1014; Y10T 292/1015; Y10T 292/54; Y10T 292/558; Y10T 292/564; Y10T 292/0801; Y10T 292/0961; Y10T 292/0962; Y10T 292/0963; Y10T 292/0969; Y10T 292/097; Y10T 292/0974; Y10T 292/0982; Y10T 292/0999
USPC ..... 292/156, 157, 158, 163, 164, 167, 292/169.14, 138, 139, 332, 335, 336, 292/DIG. 24, DIG. 26, DIG. 61, 3
See application file for complete search history.

(56) References Cited

U.S. PATENT DOCUMENTS 1,302,873 A * 5/1919 Stiff ..... E05B 63/20 292/335
2,195,542 A * 4/1940 Moore ..... E05C 5/00 292/66

(Continued)

FOREIGN PATENT DOCUMENTS

CH 239876 A * 11/1945 ..... E05B 63/20
DE 19906271 C2 * 7/2002 ..... E05B 17/2092

*Primary Examiner* — Christine M Mills
(74) *Attorney, Agent, or Firm* — Duane Morris LLP; Gregory M Lefkowitx; Steven M. Landolfi

(57) ABSTRACT

Closing device (1) with a pusher (17), a closing and opening mechanism (7) comprising at least one locking element (9), wherein the at least one locking element (9) movable by means of a latch spring (19) from an open position into a closed is characterized in that the locking spring (19) to assist the closing movement of the at least one locking element (9) in the open position has a first bias voltage by turning the pusher (17) can be generated.

7 Claims, 7 Drawing Sheets

(51) Int. Cl.

| | |
|---|---|
| ***E05C 9/02*** | (2006.01) |
| ***E05B 15/04*** | (2006.01) |
| ***E05C 1/12*** | (2006.01) |
| *E05B 1/00* | (2006.01) |

(56) References Cited

U.S. PATENT DOCUMENTS

| | | | | | |
|---|---|---|---|---|---|
| 2,281,317 | A * | 4/1942 | Buchanan | E05B 85/22 | 292/164 |
| 3,917,329 | A * | 11/1975 | Fujiki | E05B 55/00 | 292/163 |
| 4,572,556 | A * | 2/1986 | Foshee | E05B 63/16 | 292/165 |
| 4,890,870 | A * | 1/1990 | Miron | E05B 63/20 | 292/333 |
| 6,578,888 | B1 * | 6/2003 | Fayngersh | E05B 63/20 | 292/169.14 |

* cited by examiner 1
3
5
7
9
11
13
15
17
19
21
23
25
27
27.1
29
35

CLOSING DEVICE WITH A STRONG DETERRENT COMPRESSION SPRING

CROSS-REFERENCE TO RELATED APPLICATIONS

This application claims priority under 35 U.S.C. § 119 to German Patent Application No. DE 202015002250.2 filed on Mar. 24, 2015 in the German Patent and Trademark Office, the disclosure of which is incorporated herein by reference in its entirety.

The present invention relates to a locking device having a handle, a closing and opening mechanism which comprises at least one locking bar element, the at least one locking bar element being movable with the aid of a locking bar compression spring from an opening position into a locking position.

A locking device of this kind is generally known from the prior art. It is used particularly in conjunction with keyless locking means in which a locking operation is actuated automatically, when for example a door "clicks shut" or a door leaf, guided by means of a handle or knob, is aligned with its end face opposite a strike plate in the door frame. During this alignment operation, actuation is then generally dependent on a spring force that has to be overcome in order to apply sufficient tension to a locking bar element before actuation thereof. The tensioning of the locking bar element is generally achieved by means of a locking bar compression spring.

Prior-art locking devices of this kind are used equally with only one locking bar element and with a plurality of locking bar elements and with a multiple locking means. When strong tensioning of the locking bar element is needed for reliably achieving the locking position, this strong tensioning can no longer be obtained by letting a door "click shut" or the like. The force needed to bias the locking bar compression spring would be too great for this, with the result that not only are the components subjected to such a spring force movable by an audible "striking" of the door counter to the spring force but also other components such as a door frame, for example, may be damaged in the process.

The problem of the present invention is therefore to provide a locking device of the kind mentioned hereinbefore with which it is possible to achieve strong tensioning of a locking bar element in a locking operation without the disadvantages mentioned above.

The problem is solved according to the invention in that in the open position the locking bar compression spring has a first pretension (preloaded spring force), for assisting the locking movement of the at least one locking bar element, which can be produced by turning the handle.

With the present invention it is now possible to achieve tensioning (compressive stress) of a locking bar compression spring to assist the locking movement of at least one locking bar element by a manual transmission of force, i.e. by turning the handle. In this way, the spring force needed to actuate a locking process with which one or more other components of the closing and opening mechanism can be acted upon can be kept so small that a door or the like can continue to click gently into a lock so as to trigger the locking process or the locking movement of the at least one locking bar element into its locking position by this means alone.

A further advantage of the present invention is that the handle is connected to the locking bar compression spring by means of a tensioning lever, and the tensioning lever creates the tensioning (compressive stress) of the locking bar compression spring as the handle is turned. A tensioning lever of this kind has proved a useful component for transmitting the force generated by the turning of the handle to the locking bar compression spring.

Another advantage of the present invention is that the tensioning lever can be immobilised when it reaches a position which corresponds to the first pretension (preloaded spring force) of the locking bar compression spring. In this way, the locking bar compression spring is tensioned to a predetermined first pretension by means of a rotary movement of the handle and this first pretension is stored until it is needed for a locking operation.

A further advantage of the present invention is that the immobilisation of the tensioning lever is carried out by means of a detent lever arranged underneath the at least one locking bar element. The choice of a detent lever arranged underneath the at least one locking bar element as a means of immobilising the tensioning lever enables the locking device according to the invention to be made very compact in its construction.

A further advantage of the present invention is that a trigger plate for triggering the locking movement of the at least one locking bar element has a second pretension (preloaded spring force) which is less that the first pretension of the at least one locking bar element. The trigger plate is provided on an end face and projects towards the strike plate of a door frame. When a door closes, i.e. when the door "clicks shut", the trigger plate is pressed back into the locking device, counter to the direction of action of the second pretension, until the tensioning lever is released from its immobilised position by the closing and opening mechanism. As this second pretension (preloaded spring force) is very much lower than the first pretension (preloaded spring force), it does not require any great force purely to actuate it. In any case, this force is very much less than the spring force of the locking bar compression spring.

A further advantage of the present invention is that the closing and opening mechanism comprises a multiple locking means with a plurality of locking bar elements. As a result of the separation between the triggering force needed to trigger a locking movement of the at least one locking bar element and the locking force needed to perform the locking movement of the at least one locking bar element, the present invention makes it possible not only to move a plurality of locking bar elements in one and the same locking device but also to move a plurality of locking elements of a so-called multiple locking means into the locking position with a reliable locking force. The triggering force required for this remains the same, i.e. small.

Further advantages of the following invention will become apparent from the features of the other subsidiary claims.

Embodiments of the present invention are described in more detail hereinafter with reference to the drawings, wherein.

Figure 1:
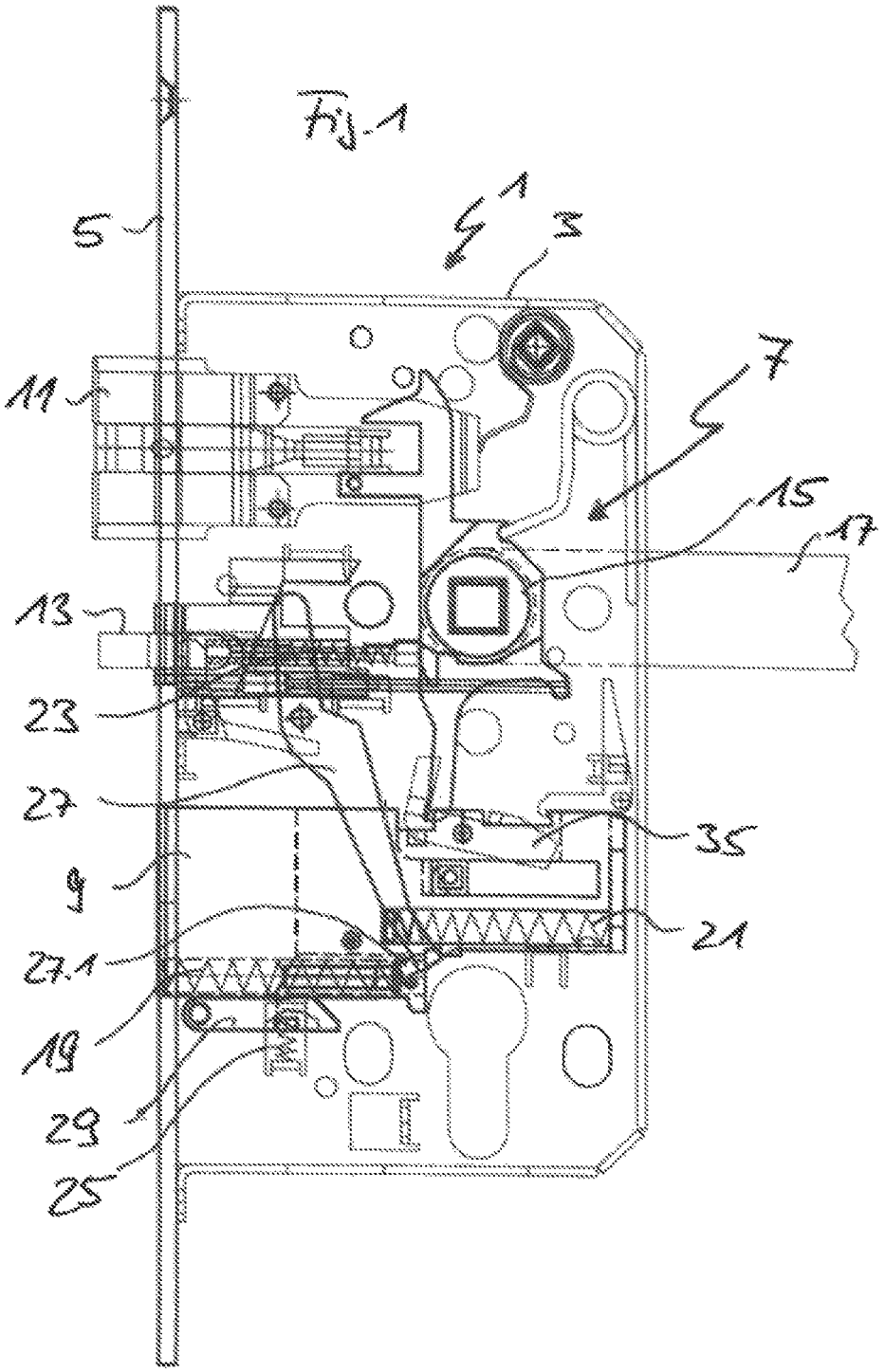
FIG. 1 shows a schematic side view of a locking device according to the present invention in a first embodiment, in the open position, with the locking bar compression spring not under compressive stress.

FIG. 1 schematically shows in side view a locking device 1 in a first embodiment. The locking device 1 comprises a lock housing 3 and an end face 5. Arranged in the lock housing 3 is a closing and opening mechanism 7. The closing and opening mechanism 7 comprises, inter alia, in the present embodiment, a locking bar element 9, a catch element 11, a trigger plate 13 and a latch 15 acted upon by a handle 17. The latch 15 is structurally connected to the locking bar element 9 and to the catch element 11 by various lever-like components, so that operation of the handle 17, i.e. clockwise rotation of the handle 17, causes the catch element 11 to be pulled back into the lock housing 3. As a result of tensioning of the catch element 11, the latter is in the position shown in FIG. 1 when the locking device is in the open position.

The closing and opening mechanism 7 essentially comprises four "tensioning" elements. The first tensioning element is a locking bar compression spring 19, the second tensioning element is a restoring spring 21, the third tensioning element is a trigger plate spring 23 and the fourth tensioning element is a detent lever spring 25. It is also possible to have further tensioning elements.

In FIG. 1, the handle 17 is in a substantially horizontal position. The locking bar compression spring 19 is not under compressive stress. The restoring spring 21 and the detent lever spring 25 are not under compressive stress either. Only the trigger plate 13 is pre-tensioned by the trigger plate spring 23 and is located, together with the catch element 11, in a position in which it protrudes from the end face 5. In this position a door (not shown) is open, for example.

Figure 2:
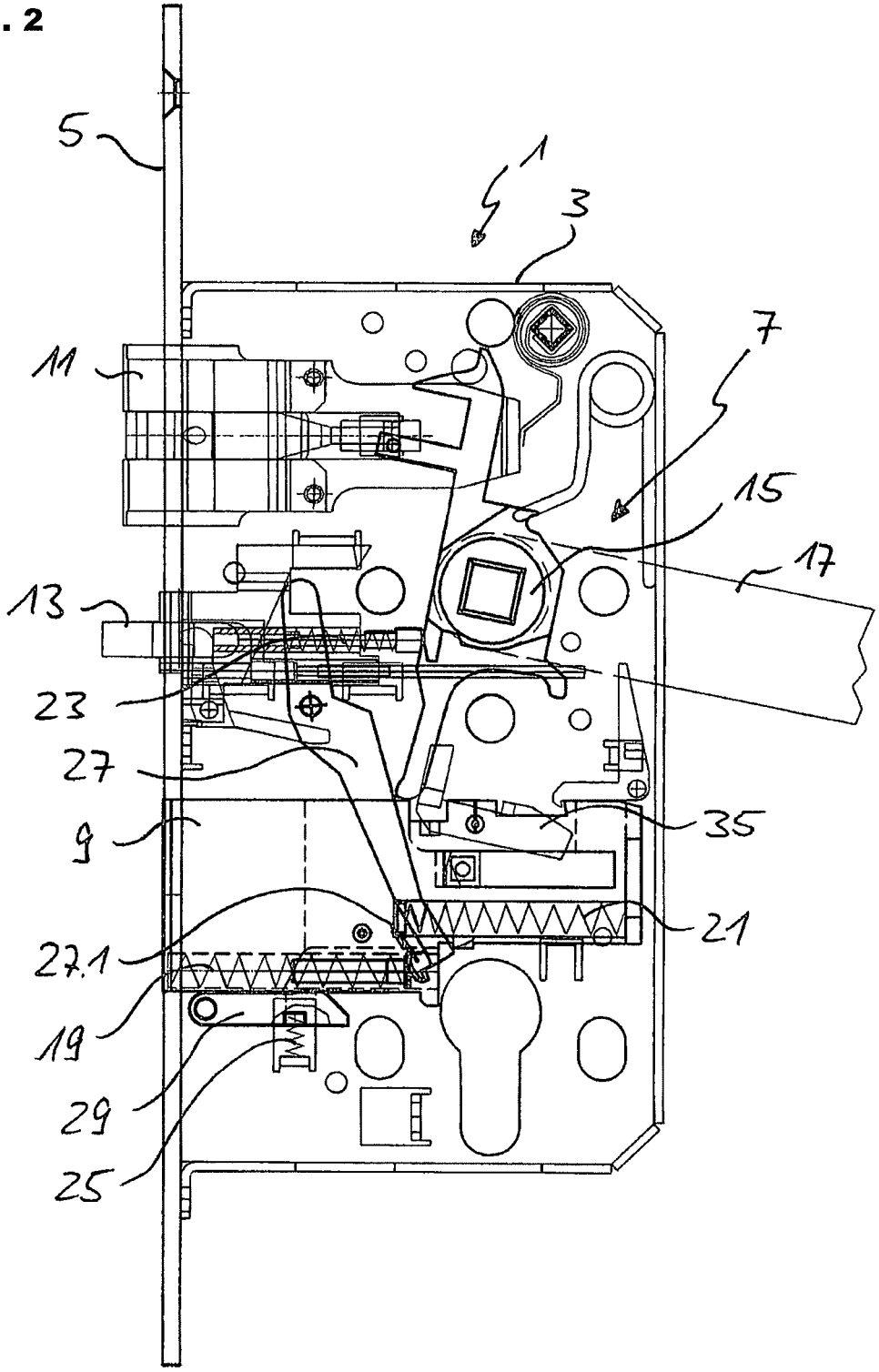
FIG. 2 shows a schematic side view of the locking device of FIG. 1, in the open position, with the locking bar compression spring being put under compressive stress.

FIG. 2 shows how the handle 17 is rotated clockwise a little before the door is closed. In FIG. 2, the handle 17 has been rotated out of its essentially horizontal alignment through 11.5° relative to the position in FIG. 1. As a result of the rotation of the handle 17 out of the alignment shown in FIG. 1 and into the alignment shown in FIG. 2, the locking bar compression spring 19 is put under compressive stress. To enable this to happen, the latch 1 to which the handle 17 is connected acts on a tensioning lever 27 which with its free end 27.1 compresses the locking bar compression spring 19 until the free end 27.1 of the tensioning lever 27 engages in a detent lever 29 and presses the latter downwards slightly, counter to the spring force of the detent lever spring 25. In this position, the detent lever is immobilised.

Figure 3:
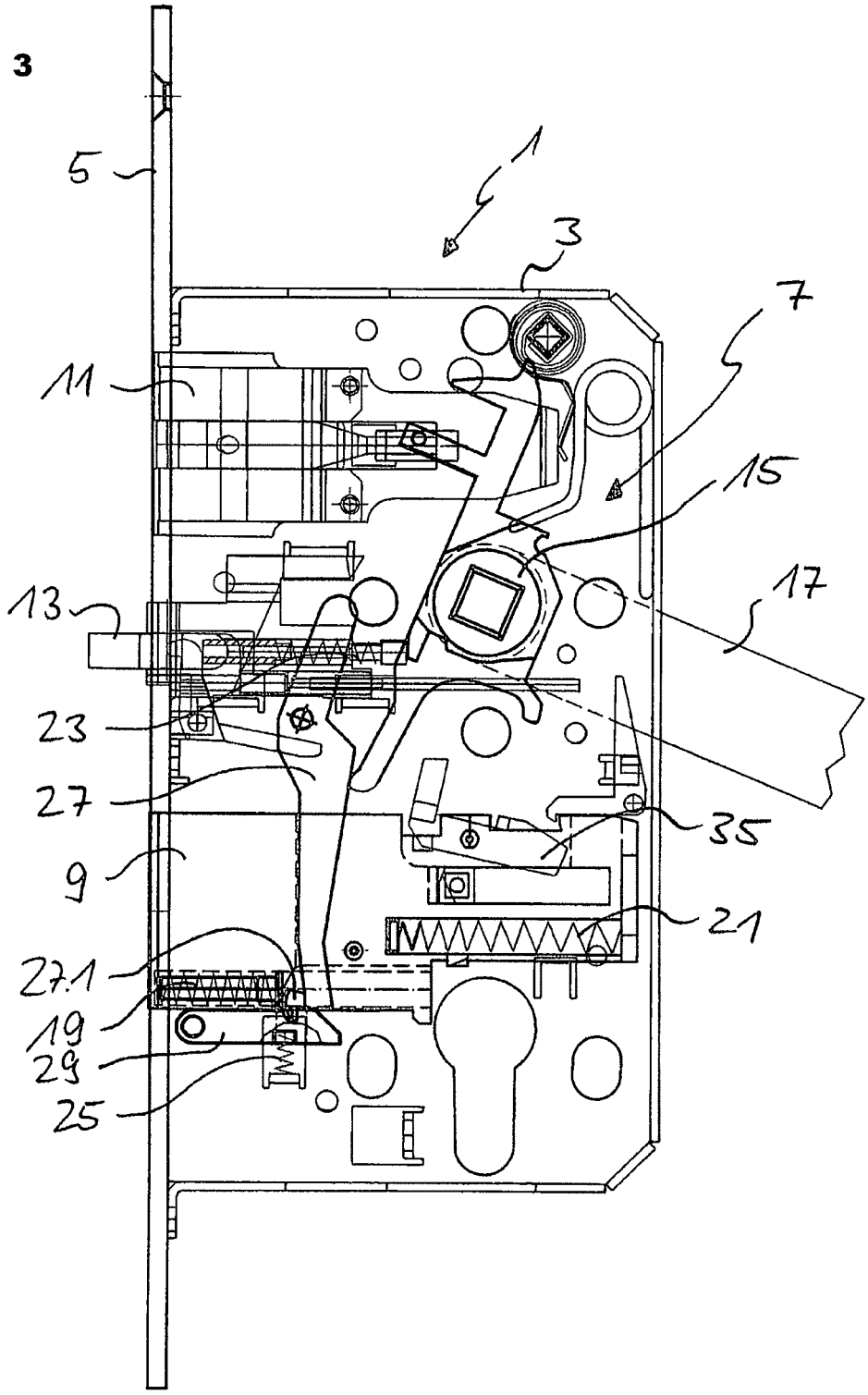
FIG. 3 shows a schematic side view of the locking device of FIG. 2, in the open position, with the locking bar compression spring under compressive stress.

In FIG. 3 the situation is just the same in relation to the at least one latching element 9 and its pre-tensioning. The movement of the handle shown in FIG. 3, which has progressed from the position shown in FIG. 2, results in a position of the handle 17 which has been rotated clockwise through 23° relative to the position in FIG. 1. The further movement of the handle in relation to FIG. 2 has resulted in the catch element 11 being withdrawn fully into the lock housing 3 in FIG. 3.

Figure 4:
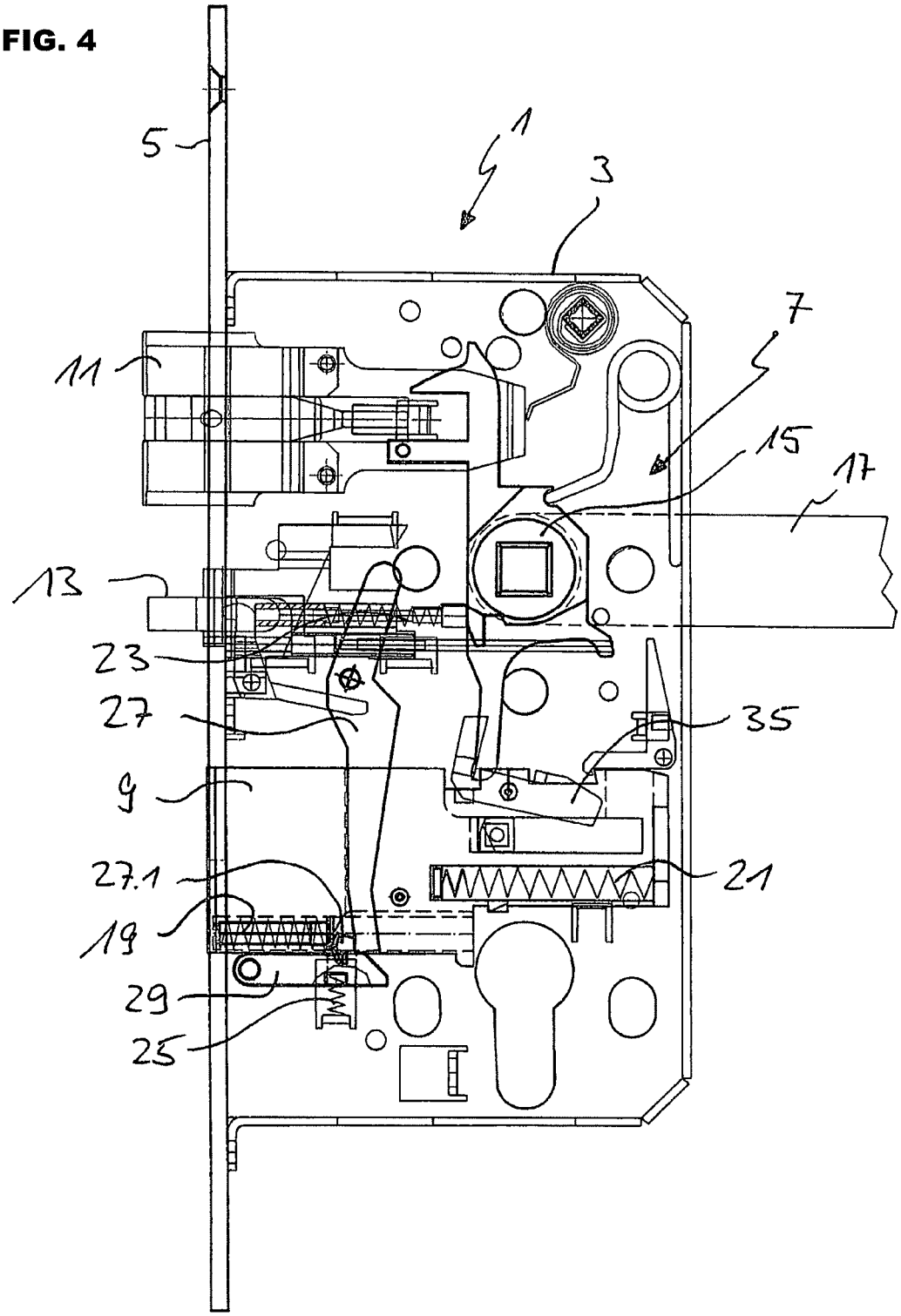
FIG. 4 shows a schematic side view of the locking device of FIG. 1, in the open position, with the locking bar compression spring under compressive stress.

FIG. 4 shows a situation in which the handle has moved back into horizontal alignment, after the situation shown in FIG. 3. The situations shown in FIG. 1 and FIG. 4 differ only in that the locking bar compression spring 19 is under compressive stress in FIG. 4 and is not under compressive stress in FIG. 1. In the setting shown in FIG. 4, the door can thus be closed, whereas in the setting shown in FIG. 1 it cannot.

A door having the locking device 1 according to the invention can be closed in the situation shown in FIG. 3.

Figure 5:
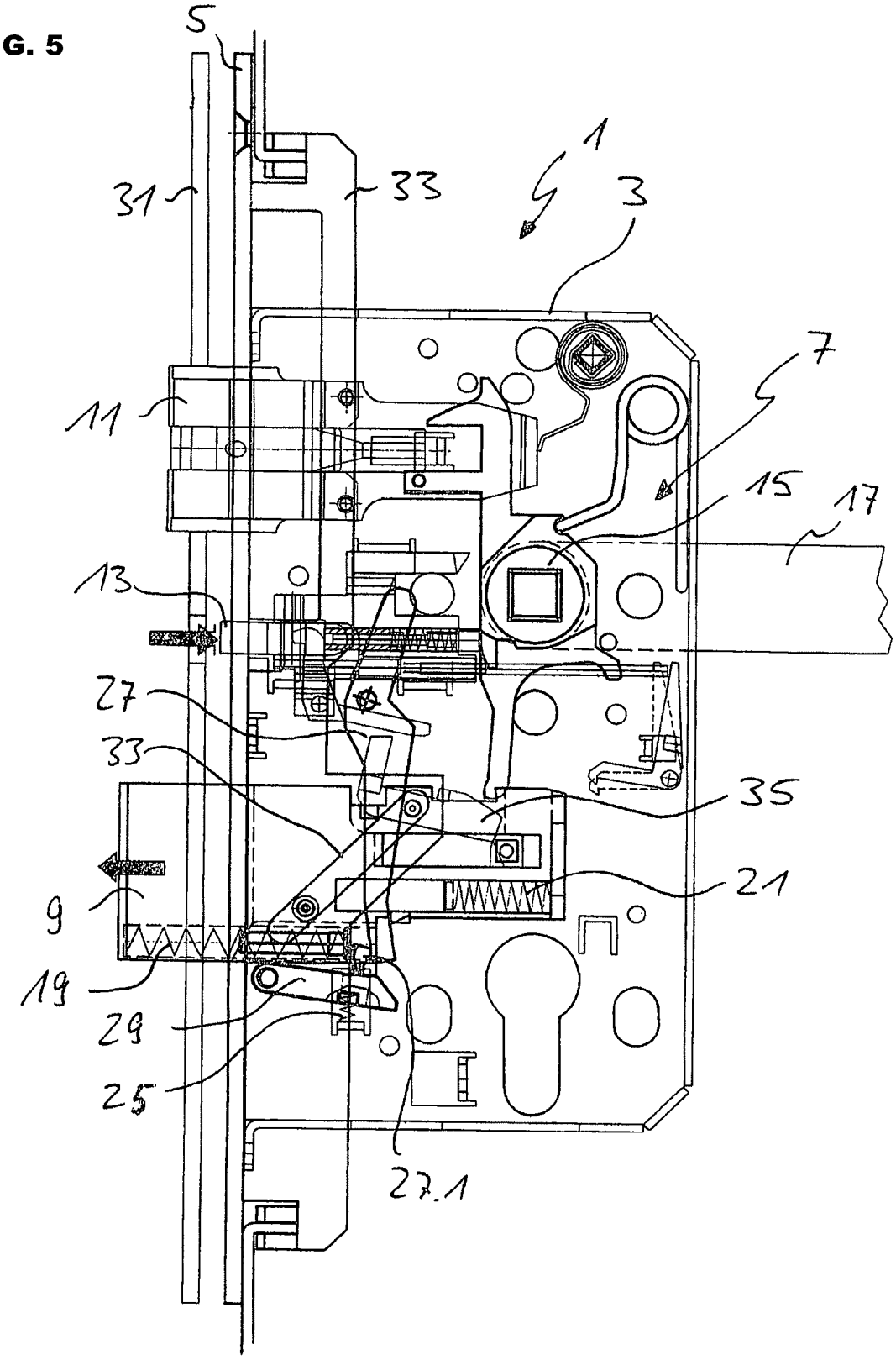
FIG. 5 shows a schematic side view of the locking device of FIG. 4, but in a second embodiment with multiple locking, in the closed position, with the locking bar compression spring relaxed, the lock closed, released by means of the detent lever.

In FIG. 5 the locking device 1 according to the invention is shown in its locked position with the door closed. As a result of the movement of the door in the situation shown in FIG. 4 into its closed position, i.e. the door leaf has been pivoted and the end face 5 has been brought into alignment with a strike plate 31 which is located on a door frame (not shown), and is now opposite the strike plate 31. During this alignment, the trigger plate 13 was in the way, so that during this operation it was pressed into the lock housing 3 counter to the force of the trigger plate spring 23 (second pretension) (cf. the arrow). As a result of being pressed into the lock housing 3, the trigger plate 23 has released the immobilisation of the detent lever 29, so that the at least one locking bar element 9 has been moved into the closed position (see the arrow) under the effect of the strong spring force (first pretension) of the locking bar compression spring 19. In the situation shown in FIG. 5, the locking bar element 9 and the catch element 11 engage in corresponding recesses in the strike plate 31. The door is locked. The first pretension of the locking bar compression spring 19 can thus be made substantially greater than the second pretension of the trigger plate spring 23.

Further to the first embodiment with only one locking bar element 9, FIG. 5 also shows a second embodiment having an integrated multiple locking means 33. The multiple locking means 33 is of known construction and will not therefore be described further here. The multiple locking means 33 is connected to the closing and opening mechanism 7, again in known manner, by means of a release device 35. The closing movement described hereinbefore by means of the strong first pretension of the locking bar compression spring 19 and the weaker second pretension of the trigger plate spring 23 is transmitted to the multiple locking means 33 and its locking bars (not shown) through the closing and opening mechanism 7. During the closing process, the closing and opening mechanism 7 stresses the restoring spring 21 which withdraws the at least one locking bar element 9 into the lock housing 3 during an opening operation.

Figure 6:
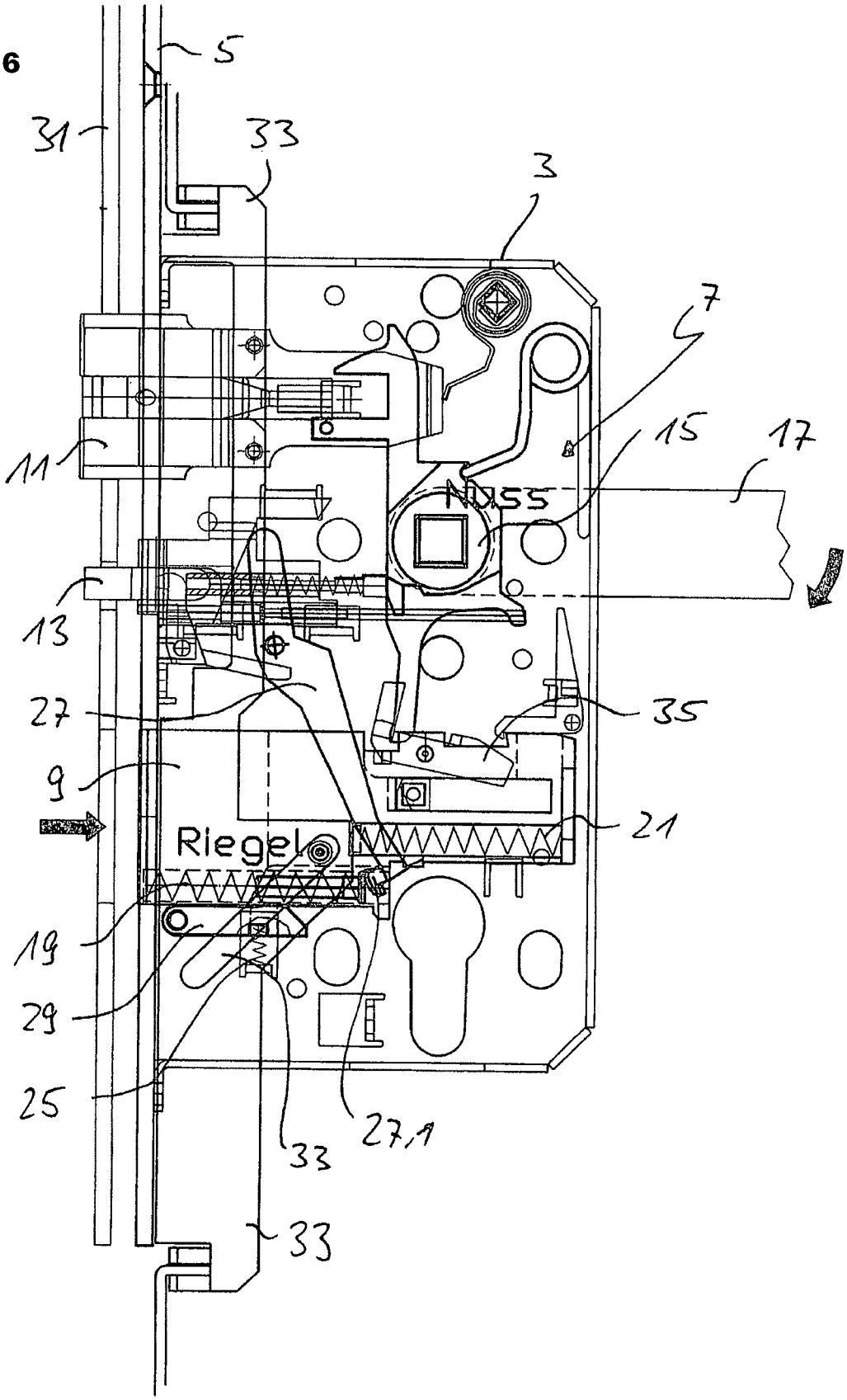
FIG. 6 shows a schematic side view of the locking device of FIG. 5, in the open position, with the locking bar compression spring relaxed.

FIG. 6 schematically shows how the situation shown in FIG. 5 changes when the door is indeed closed, i.e. the catch element 11 and the trigger plate 13 are engaging in the corresponding recesses in the strike plate 31, but the at least one locking bar element 9 has been withdrawn, so that the door can be opened using the handle 17. When the handle 17 is rotated slightly downwards in the clockwise direction, as indicated by the arrow, the release device 35, 50 is also unlocked, so that the locking bars of the multiple locking device 33 are also pulled back. The tensioning lever 27 is located with its free end 27.1 disengaged from the detent lever 29. Basically, the situation is once more the same as that shown in FIG. 1.

Figure 7:
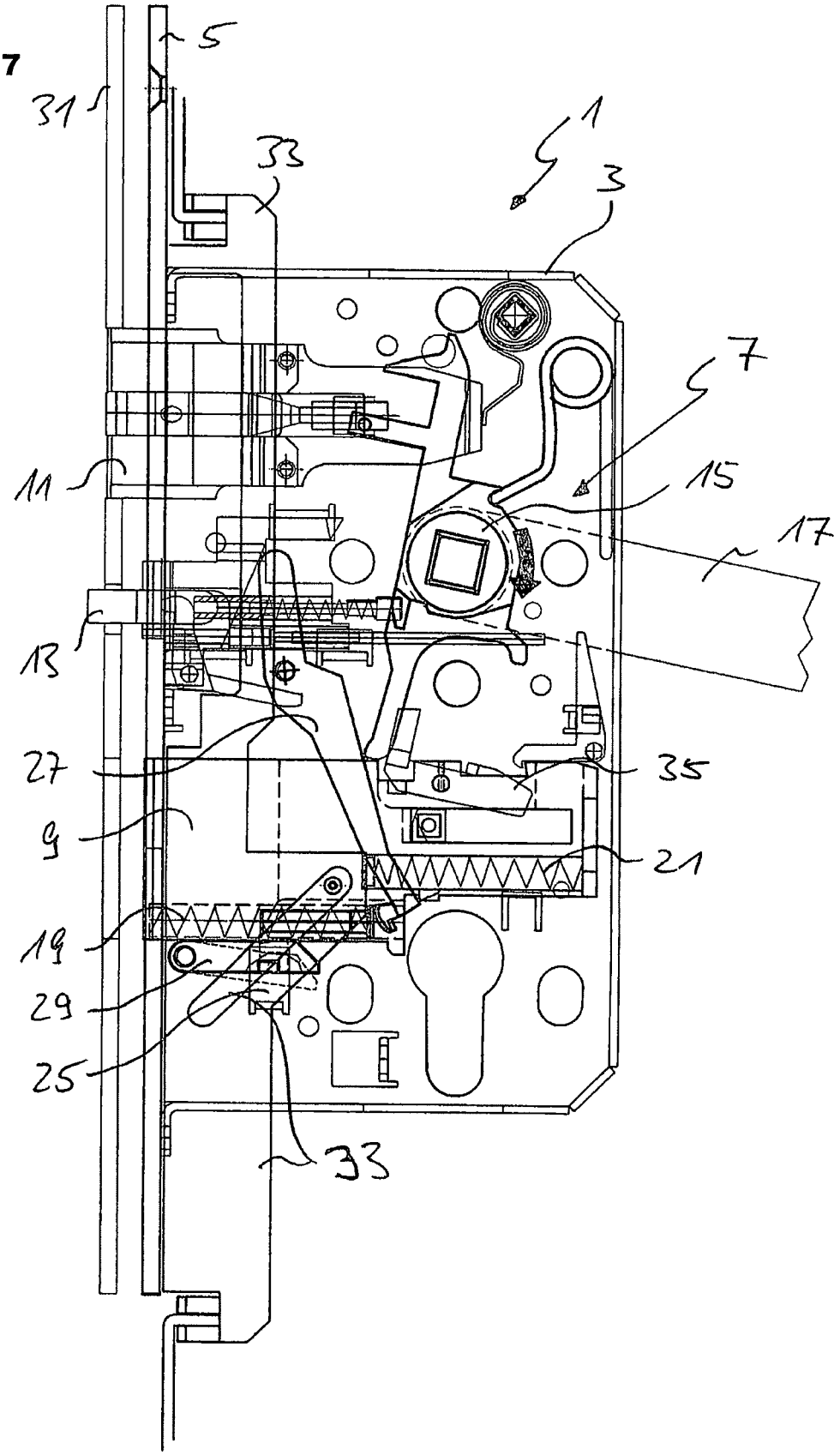
FIG. 7 shows a schematic side view of the locking device of FIG. 6, in the open position; the locking bar compression spring is compressed again when the door opens.

Further turning of the handle in the clockwise direction leads to the situation shown in FIG. 7 and basically corresponds once more to the situation shown in FIG. 2. The process of compressing the locking bar compression spring 19 described above is then repeated. In FIG. 7, too, the latch

15 rotates and the tensioning lever 27 stresses the locking bar compression spring 19. The catch element 11 is still in the associated recess in the strike plate 31.

LIST OF REFERENCE NUMERALS

1 locking device
3 lock housing
5 end face
7 closing and opening mechanism
9 locking bar element
11 catch element
13 trigger plate
15 latch
17 handle
19 locking bar compression spring
21 restoring spring
23 trigger plate spring
25 detent lever spring
27 tensioning lever
27.1 free end of the tensioning lever
29 detent lever
31 strike plate
33 multiple locking means
35 release device

The invention claimed is:

1. Locking device (1) comprising a handle (17), a closing and opening mechanism (7) which comprises at least one locking bar element (9), the at least one locking bar element (9) being movable by means of a locking bar compression spring (19) from an opening position into a locking position, wherein the locking bar compression spring (19) has a first preloaded spring force in the opening position for supporting a closing movement of the at least one locking bar element (9), wherein the locking bar compression spring (19), in the opening position, is in one setting free of tension and has the first preloaded spring force in another setting, after rotating the handle (17)

wherein the handle (17) is connected to the locking bar compression spring (19) via a tensioning lever (27) and the tensioning lever (27) creates the first preloaded spring force of the locking bar compression spring (19) as the handle (17) is turned, wherein the tensioning lever (27) can be immobilised as it reaches a position which corresponds to the first preloaded spring force of the locking bar compression spring (19), wherein a trigger plate (13) has a second preloaded spring force for triggering the closing movement of the at least one locking bar element (9), said second preloaded spring force being less than the first preloaded spring force of the at least one locking bar element (9), wherein during a closing operation the trigger plate (13) moves in the opposite direction to the second preloaded spring force and releases the tensioning lever (27) from its position of immobilisation, such that the at least one locking bar element (9) moves automatically into the locking position.

2. Locking device according to claim 1, wherein the closing and opening mechanism (7) comprises a multiple locking means having a plurality of locking bar elements (9).

3. Locking device according to claim 2, wherein the multiple locking means (33) comprises a release device (35) which releases the multiple locking means (33) during an opening operation.

4. Locking device according to claim 3, wherein the release of the multiple locking means (33) is carried out by the release device (35) by rotation of the handle (17).

5. Locking device according to claim 3, wherein the release of the multiple locking means is effected by the release device (35) by means of the trigger plate (13).

6. Locking device according to claim 1, wherein the first preloaded spring force of the locking bar compression spring (19) takes place when at least half of a maximum movement of the handle (17) is reached.

7. Locking device (1) comprising a handle (17), a closing and opening mechanism (7) which comprises at least one locking bar element (9), the at least one locking bar element (9) being movable by means of a locking bar compression spring (19) from an opening position into a locking position, wherein the locking bar compression spring (19) has a first preloaded spring force in the opening position for supporting a closing movement of the at least one locking bar element (9), wherein the locking bar compression spring (19), in the opening position, is in one setting free of tension and has the first preloaded spring force in another setting, after rotating the handle (17), wherein the handle (17) is connected to the locking bar compression spring (19) via a tensioning lever (27) and the tensioning lever (27) creates the first preloaded spring force of the locking bar compression spring (19) as the handle (17) is turned, wherein the tensioning lever (27) can be immobilised as it reaches a position which corresponds to the first preloaded spring force of the locking bar compression spring (19), wherein the immobilisation of the tensioning lever (27) is carried out by means of a detent lever (25) arranged underneath the at least one locking bar element (9).

* * * * *